US006113447A

United States Patent [19]

Roy et al.

[11] Patent Number: 6,113,447

[45] Date of Patent: Sep. 5, 2000

[54] WATERCRAFT WITH FRONTFACE OAR SYSTEM

[75] Inventors: Roger Roy, Rock Forest; Patrick Salvail, Sherbrooke, both of Canada

[73] Assignee: Rowsurf Plastique Ltd., Lac Megantic, Canada

[21] Appl. No.: 09/298,941

[22] Filed: Apr. 26, 1999

[51] Int. Cl.[7] ..... B63H 16/10

[52] U.S. Cl. ..... 440/102; 440/104

[58] Field of Search ..... 440/102–104, 440/105

[56] References Cited

U.S. PATENT DOCUMENTS

| | | | |
|---|---|---|---|
| 522,545 | 7/1894 | Wright . | |
| 562,369 | 6/1896 | Berron | 440/103 |
| 568,707 | 9/1896 | Schnicke | 440/103 |
| 611,497 | 9/1898 | Lucier | 440/103 |
| 1,476,987 | 12/1923 | Larsen | 440/102 |
| 3,884,175 | 5/1975 | Bellis . | |
| 4,411,214 | 10/1983 | Horiuchi . | |
| 4,623,314 | 11/1986 | Waugh . | |
| 5,037,339 | 8/1991 | Smith | 440/102 |

*Primary Examiner*—Sherman Basinger
*Attorney, Agent, or Firm*—François Martineau

[57] ABSTRACT

The watercraft has an elongated hollow hull having a pair of integral outwardly and upwardly projecting outrigger wings, onto which are mounted oar mounting devices each having a flat casing attached to rods protruding out of the outrigger wings. The attachment of the casing to the rods is accomplished with sockets installed on the rods, which have spherical housings engaged by ball joint portions provided on the casing, to form a ball and socket joint. The sockets are longitudinally spaced-apart on the hull side edge portion, so as to allow the casing to swivel about an axis parallel to the watercraft longitudinal axis. The casing is engaged by a pair of oar members pivoted therein in the plane of the flat casing. A pair of wires interconnect the pivoted oar members inside the casing, to allow pivotal displacement of the oar members only in opposite directions. The rods which protrude out of the outrigger wings are the ends of attachment rods crossing through the hull transversely, thus allowing a secure attachment of the oars onto the watercraft.

7 Claims, 8 Drawing Sheets

90
110
144'
84
112
114
116
118
148
144
88

Fig. 4
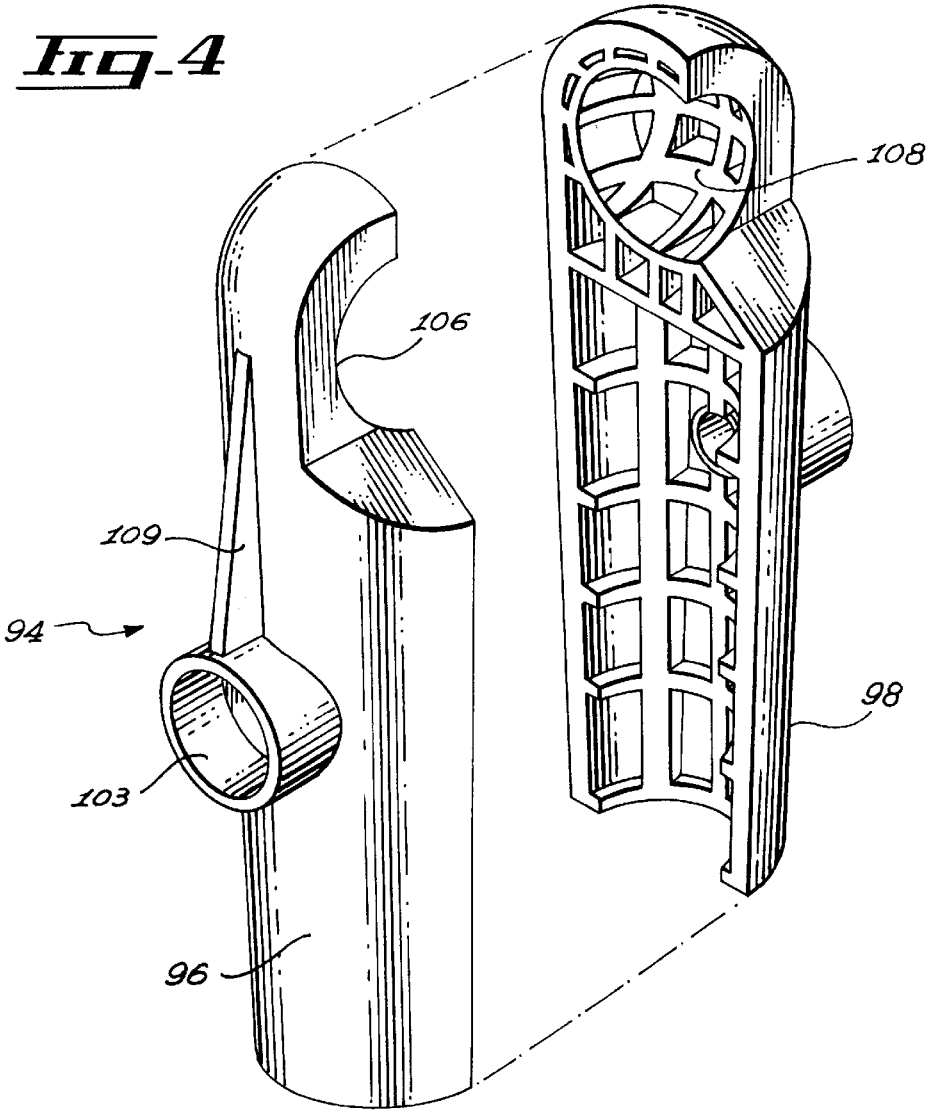
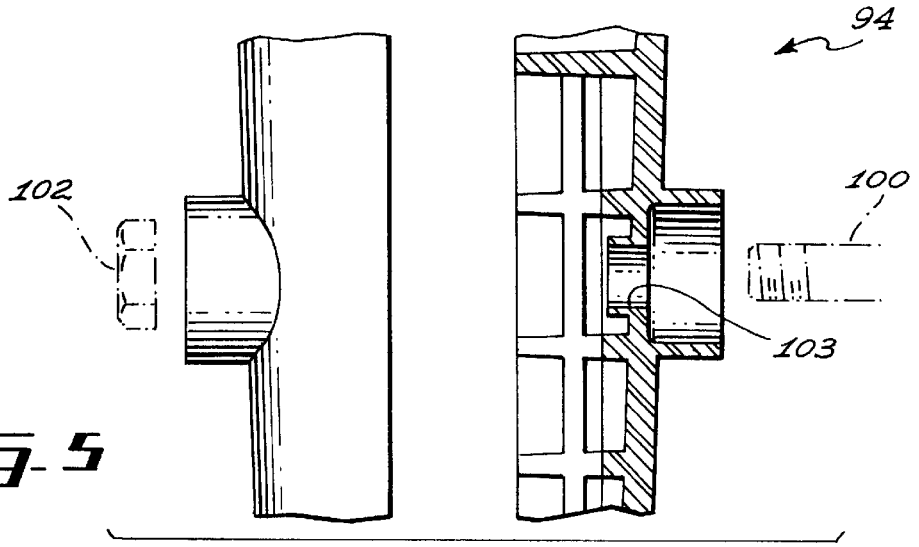
Fig. 5

Fig. 11
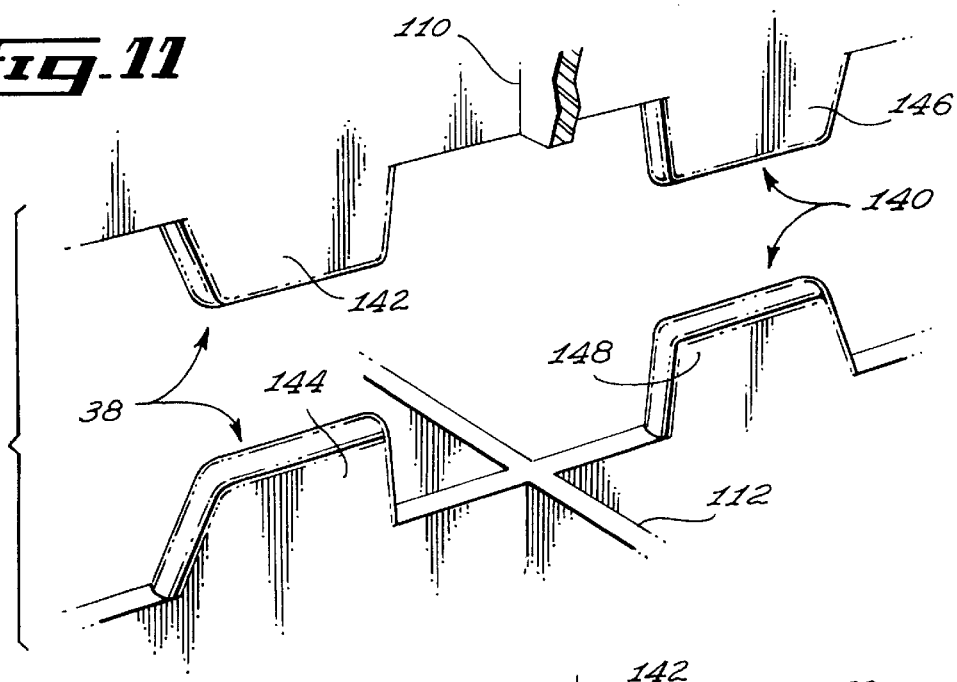
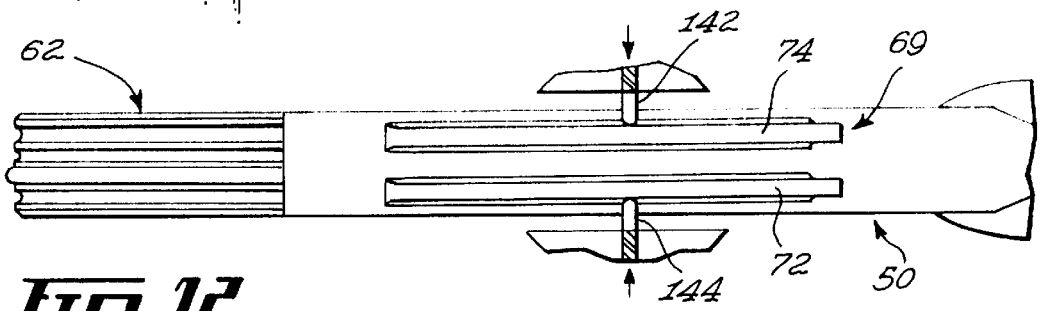
Fig. 12
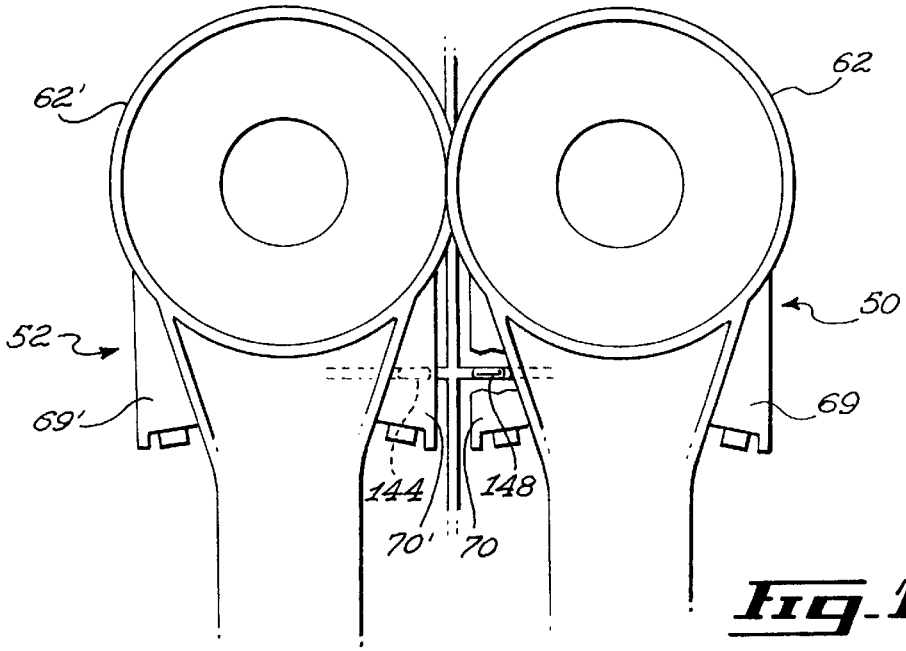
Fig. 13

WATERCRAFT WITH FRONTFACE OAR SYSTEM

FIELD OF THE INVENTION

The present invention relates to watercrafts, and more particularly to a frontface oar system for watercrafts.

BACKGROUND OF THE INVENTION

U.S. Pat. No. 522,545 issued in 1894 to I.D. Wright shows a device for inverting the movement of an oar. More particularly, the oar comprises two distinct oar sections which radially engage respective tangentially adjacent cylindrical sockets pivoted onto a swivelled support member. The sockets are linked to each other by means of a pair of wires each attached at its first end to a first socket and at its second end to a second socket, although on the opposite side relative to the first socket, with each wire crossing the other wire between the two tangentially adjacent cylindrical socket walls. Thus, upon pivoting the handle oar section rearwardly, the paddle oar section is also pivoted rearwardly, for forwardly propelling the watercraft in the water. A person may thus sit in the watercraft while facing the bow of the watercraft when rowing, and still benefit from the full strength of a rearwards shoulder and arm motion to pivot the oars for frontwardly propelling the watercraft.

U.S. Pat. No. 3,884,175 issued in 1975 to G.D. Bellis shows another device for inverting the movement of an oar. This device is similar to the above-mentioned Wright device, although it includes interconnected geared sockets instead of the wire-interconnection detailed hereinabove. The Bellis patent further shows a swivel mount for allowing the oar inverting device to be swivelled onto the watercraft, for allowing pivotal movement of the oars in a vertical plane; this vertical pivotal movement of the oar is necessary, to allow the user of the watercraft to alternately take the oars out of the water during the forward paddle stroke, and into the water during the rearward propelling paddle stroke. As can be seen in the Bellis patent, the swivel mount simply comprises coextensive ears engaging a complementary slot in a bracket fixed to the watercraft, which allows the oars to pivot in a vertical plane.

The problem associated with the above-described Wright and Bellis patents is that the oar inverting device is not attached to the watercraft hull securely, nor in a manner which allows versatile displacement of the oars. For example, in the Bellis patent, the swivel mount could be accidentally released from the upwardly open slot in which it rests.

U.S. Pat. No. 4,411,214 issued in 1983 to K. Horiuchi shows that it is known to provide inner reinforcement tubes (reference number 8 in FIG. 3 of the Horiuchi patent), that are located inside the watercraft hull and attached on the inner face thereof, with the oar outriggers (reference number 6 in the Horiuchi patent) being attached on the opposite outer face of the hull, in register with the inner tubes. The inner tubes, however, require complex installation techniques, especially if rotomoulding techniques are used to mould the watercraft hull. Moreover, the attachment of the outriggers to the hull will cause important stresses to be induced into the proximate hull wall, which may result in fissuring and breakage of the hull wall with concurrent accidental release of the outrigger attachment from the hull.

U.S. Pat. No. 4,623,314 issued in 1986 to G.B. Waugh shows that it is known to provide single outrigger arms to pivotally support the oars at an intermediate portion thereof, away from the hull side edges.

OBJECTS OF THE INVENTION

It is an object of the present invention to provide a watercraft having an oar inverting mechanism securely and stably supported on the watercraft, and allowing suitable vertical pivotal displacement of the oars.

SUMMARY OF THE INVENTION

The present invention relates to a frontface oar system for watercrafts.

More particularly, the invention relates to the combination of a watercraft and a frontface oar system mounted to said watercraft, said watercraft having an elongated hull defining a longitudinal axis linking a bow and a stern, and two side edge portions integrally flanking said hull, said frontface oar system comprising a pair of oars each having an oar paddle member defining a first end portion and a second opposite free paddle end portion, and an oar handle member defining a first end portion and a second opposite free handle end portion, said oar system further comprising a pair of oar mounting members each comprising:

- a pair of longitudinally spaced-apart socket members fixedly attached to a corresponding said watercraft side edge portion, each said socket member defining an opened spherical housing having an opening in facing register with the opening of the other socket member of said pair of socket members;
- an open casing having a pair of integral ball joint members each engaged in a respective socket housing through a corresponding said opening, for forming a ball and socket joint allowing swivelling displacement of said casing about an axis parallel to said watercraft longitudinal axis, with the first end portions of both said oar paddle member and said oar handle member being pivotally attached to said casing adjacent to each other for operative pivotal displacement of said oar members in a common pivotal plane;
- a reversing device, operatively interconnecting the respective first ends of said oar paddle member and of said oar handle member for allowing pivotal displacement of said oar paddle member and said oar handle member only in opposite directions in said common pivotal plane; wherein upon a said oar handle member being forcibly pivoted in a first direction, the corresponding said oar paddle member will be pivoted in an opposite direction in said common pivotal plane, and wherein said common pivotal plane can be angularly adjusted by forcibly swivelling said casings about said ball and socket joints, with said oar handle members acting as levers for swivelling said casings.

Preferably, said oar system further comprises a pair of attachment rods each integrally linking a socket member of an oar mounting member with a corresponding socket member of the other oar mounting member from said pair of oar mounting members, with each said rod extending through and into said watercraft hull and transversely of said elongated hull.

Preferably, said attachment rods extend parallel to each other, with the frontmost socket member of each said pair of longitudinally spaced-apart socket members being linked to the frontmost socket member of the other pair of longitudinally spaced-apart socket members.

Preferably, said watercraft hull further defines a main elongated body and integral outrigger wings extending outwardly and upwardly from said main body so as to define lateral outer edge portions that form part of said hull side edge portions, with said oar mounting members being mounted to said lateral outer edge portions of said outrigger wings.

Preferably, said outrigger wings are arcuate and upwardly concave.

Preferably, each said casing further comprises an integral jaw in which at least either one of said handle oar member first end portion and said paddle oar member first end portion is releasably frictionally and resiliently engageable to allow said oar members to be releasably fixedly positioned and aligned along and adjacent said watercraft side edge portions in an uncumbersome inoperative position, with said jaw being positioned in said casing to allow unobstructed rowing pivotal displacement of said oars in positions spaced from said inoperative position.

Preferably, said first end portions of said paddle and handle oar members are cylindrical and slidably pivot between spaced-apart flat walls defined in said casing, said paddle and handle oar members first end portions each having integral anchoring brackets radially projecting therefrom, and wherein said reversing device includes first and second flexible wires each anchored to a said bracket of said paddle oar member first end portion and to a said bracket of said handle oar member first end portion for allowing a pivotal displacement of said handle and paddle oar members only in opposite directions in said common pivotal plane.

Preferably, each said casing further comprises an integral jaw in which a bracket of at least either one of said handle oar member first end portion and said paddle oar member first end portion is releasably frictionally and resiliently engageable to allow said oar members to be releasably fixedly positioned and aligned along and adjacent respective said watercraft side edge portions in an uncumbersome inoperative position, while said jaw is positioned in said casing to allow unobstructed rowing pivotal displacement of said oars in positions spaced from inoperative position.

DESCRIPTION OF THE DRAWINGS

In the annexed drawings:

FIG. 4 is an enlarged exploded view of a socket member of the mounting member of FIG. 2;

FIG. 5 is a partial exploded side elevation of the socket member of FIG. 4, partly in cross-section, suggesting in phantom lines a bolt and nut used to assemble the two halves of the socket member to the watercraft reinforcement rod (not shown);

FIG. 11 is an enlarged perspective view of the jaws located inside the casing;

FIG. 12 is an elevational view, partly in cross-section, of the jaws operatively frictionally engaging the resilient bracket of an oar sleeve member; and FIG. 13 is a top plan view, partly broken, showing the parallel disposition of two interconnected oar sleeve members engaging the inner jaws of the casing.

DETAILED DESCRIPTION OF THE EMBODIMENTS

Figure 1:
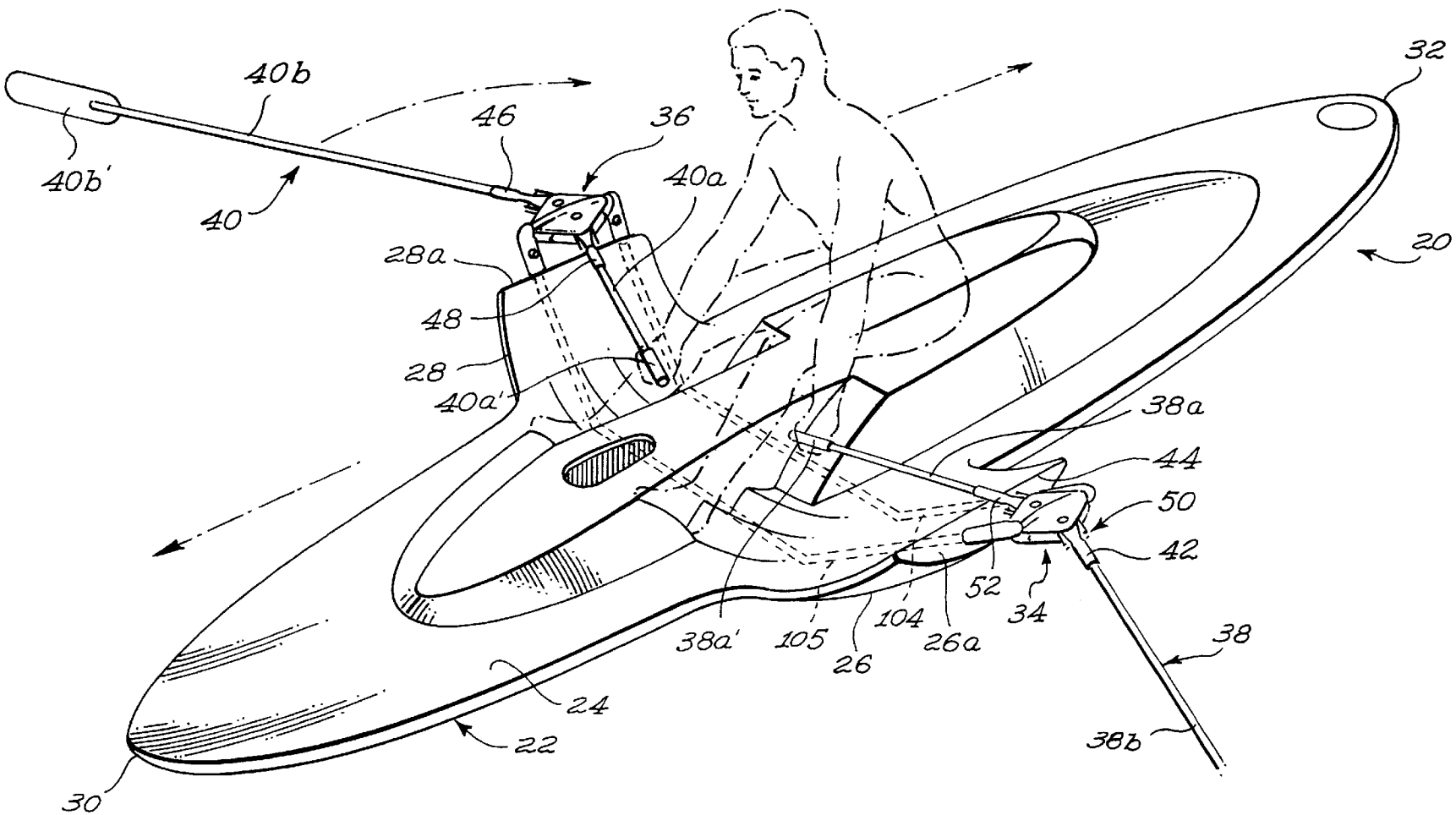
FIG. 1 is a perspective view of a watercraft with a frontface oar system according to the invention, suggesting in phantom lines a rower seated on the watercraft and using same.

FIG. 1 shows a watercraft 20 according to the invention, having a hollow elongated hull 22 defining a longitudinal axis and a main body 24 from which outwardly and upwardly project integral outrigger wings 26, 28 which are arcuate and upwardly concave. Outrigger wings 26, 28 are located intermediate the bow 30 and the stern 32 of watercraft 20, and each support on their outer lateral edge portions 26*a*, 28*a* a corresponding oar mounting member 34, 36 according to the invention. Each oar mounting member 34, 36 operatively carries an oar 38, 40 having oar handle members 38*a*, 40*a* and oar paddle members 38*b*, 40*b*.

Figure 2:
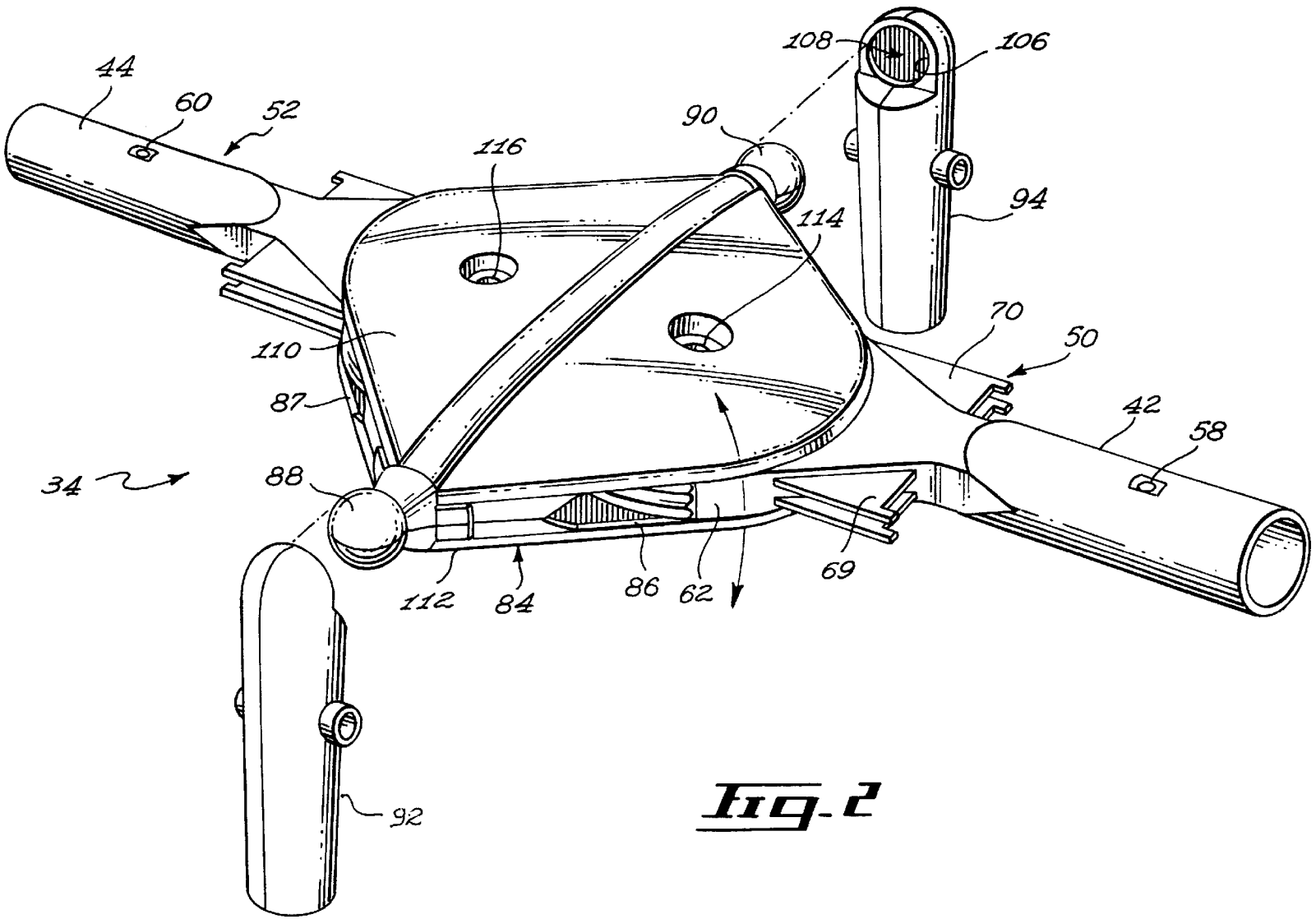
FIG. 2 is an enlarged partly exploded perspective view of the oar mounting member according to the invention, operatively engaged by the oar sleeve members.
Figure 3:
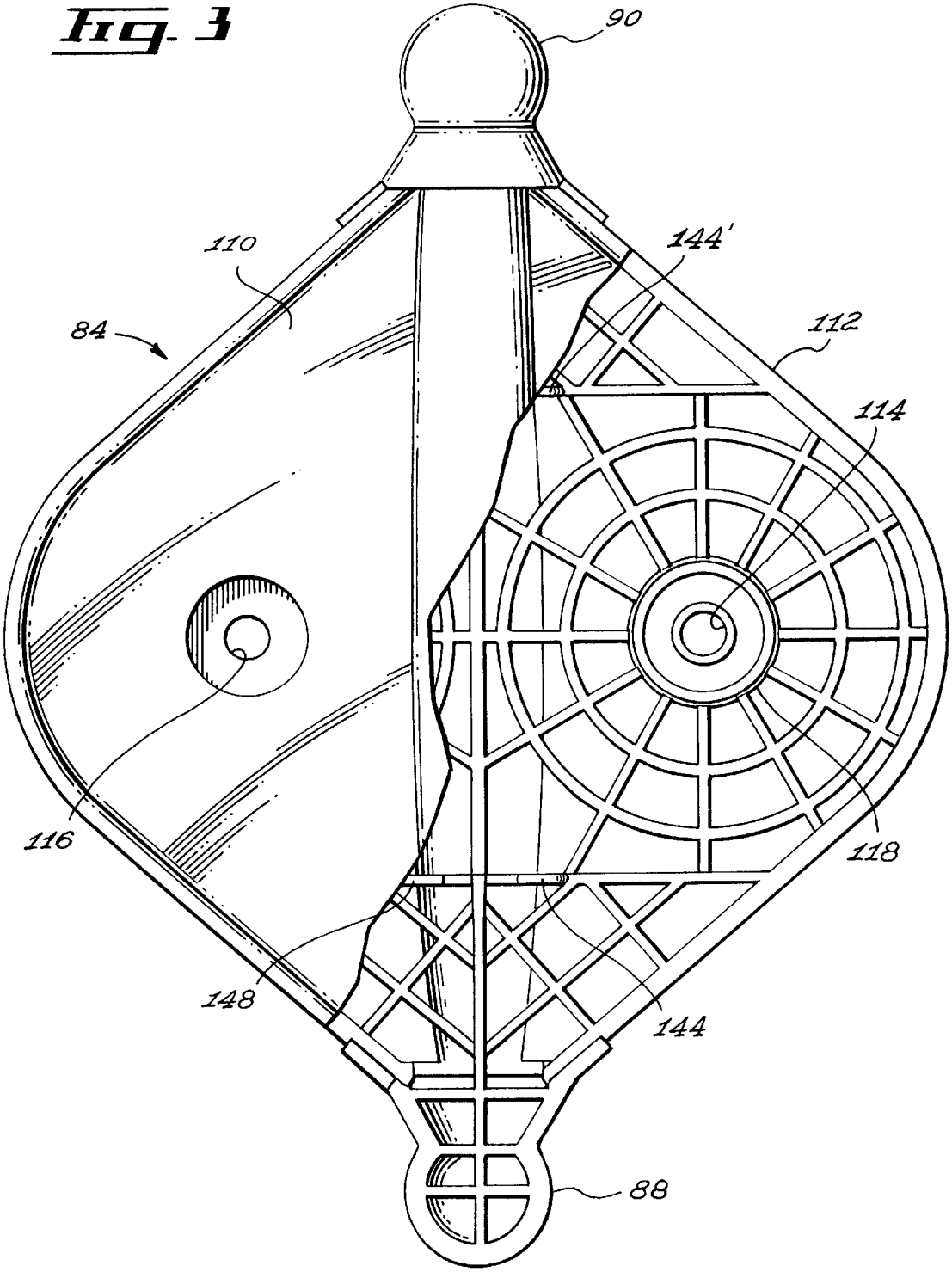
FIG. 3 is a partly broken enlarged top plan view of the casing of the mounting member of FIG. 2.

As shown in FIGS. 1 and 2, oar handle members 38*a*, 40*a* and oar paddle members 38*b*, 40*b* have a main elongated shaft engaged and attached at their first end in the sleeves 42, 44, 46, 48 of respective sleeve members 50, 52, 54, 56, with the four sleeve members being identical. Oar handle members 38*a*, 40*a* define a second end provided with a handle 38*a*', 40*a*', opposite their first end; and oar paddle members 38*b*, 40*b* define a second end provided with a paddle 38*b*'(with the paddle of paddle member 40*b* not being shown in FIG. 1), opposite their first end.

Figure 10:
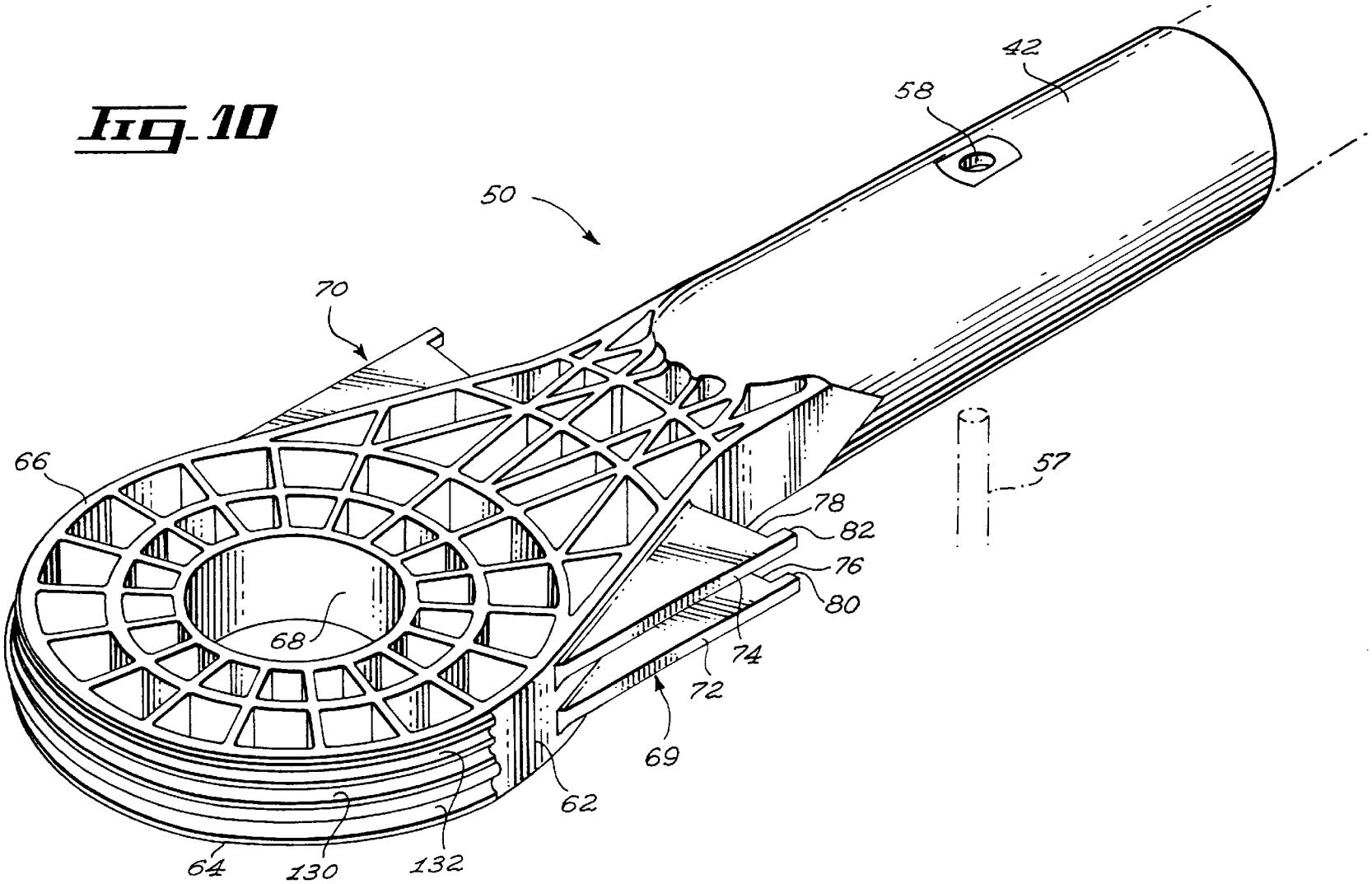
FIG. 10 is a perspective view, at an enlarged scale, of an oar sleeve member.

FIG. 2 shows first oar mounting member 34, although it is understood that both oar mounting members 34, 36 are identical. Oar mounting member 34 is engaged by the above-mentioned sleeve members 50, 52 in a manner described hereinafter. Sleeves 42, 44 are in turn engaged by the first ends of the shafts of the oar paddle member 38*b* and the oar handle member 38*a*, the latter being attached to sleeves 42, 44 by means of bolts 57 (FIG. 10) engaging transverse holes 58, 60 in sleeves 42, 44 and complementary transverse holes (not shown) in the oar member shafts. FIG. 10 further shows that each sleeve member, for example sleeve member 50, further comprises a cylindrical pivotal head portion 62 which is honeycombed so as to combine a suitable structural rigidity with a lower weight. Cylindrical head portion 62 is tangentially integrally attached to sleeve 42, and has flat lower and upper faces 64, 66 and a cylindrical central bore 68. Brackets 69, 70 are also integrally provided on head portion 62, with each bracket, for example bracket 69, defining a pair of spaced-apart triangular plates 72, 74 which tangentially diverge from head portion 62 to form a shoulder 76, 78 with an outer retaining finger 80, 82.

As shown in FIG. 2, the head portion 62 of sleeve member 50 engages an open casing 84 of mounting member 34, through a lateral opening 86 in casing 84.

Casing 84 has a pair of endwise ball joint members 88, 90, which engage complementary socket members 92, 94 in a manner described hereinafter. Each socket member, for example socket member 94 as shown in FIGS. 4 and 5, is generally cylindrical and hollow, and is made from two halves 96, 98 which can be attached to each other by means of a transverse bolt and nut 100, 102, bolt 100 engaging a transverse passage 103 provided in socket member 94. Socket member 94 axially engages an attachment rod 104 (FIG. 1) embedded in the watercraft hull 22 and protruding outwardly of the lateral edge portion 26*a* of outrigger wing 26, as detailed hereinafter, so as to securely fix socket member 94 to watercraft hull 22, with bolt 100 engaging a transverse hole (not shown) in rod 104, similarly, socket 92 axially engages and is attached to a rod 105 protruding outwardly from the outrigger wing outer lateral edge portion 26*a*. As seen in FIGS. 4 and 5, the inner surface of socket member 94 is ribbed to reinforce same while maintaining a lower weight therefor. Furthermore, as shown in FIG. 4 (only), socket member 94 can have an integral reinforcing rib 109 longitudinally running along its upper portion and further resting on the bolt channel 103.

As shown in FIGS. 2 and 4, socket member 94 forms, at its end opposite hull 22, an opening 106 allowing access into an open spherical housing 108. The housings 108 of sockets 92 and 94 are in facing register with each other. Ball joint members 88, 90 of casing 84 engage the complementary spherical housings 108 of socket members 92, 94 to form therewith a ball and socket joint, allowing casing 84 to be trapped between socket members 92, 94 and to swivel about an axis parallel to the watercraft longitudinal axis.

Figure 6:
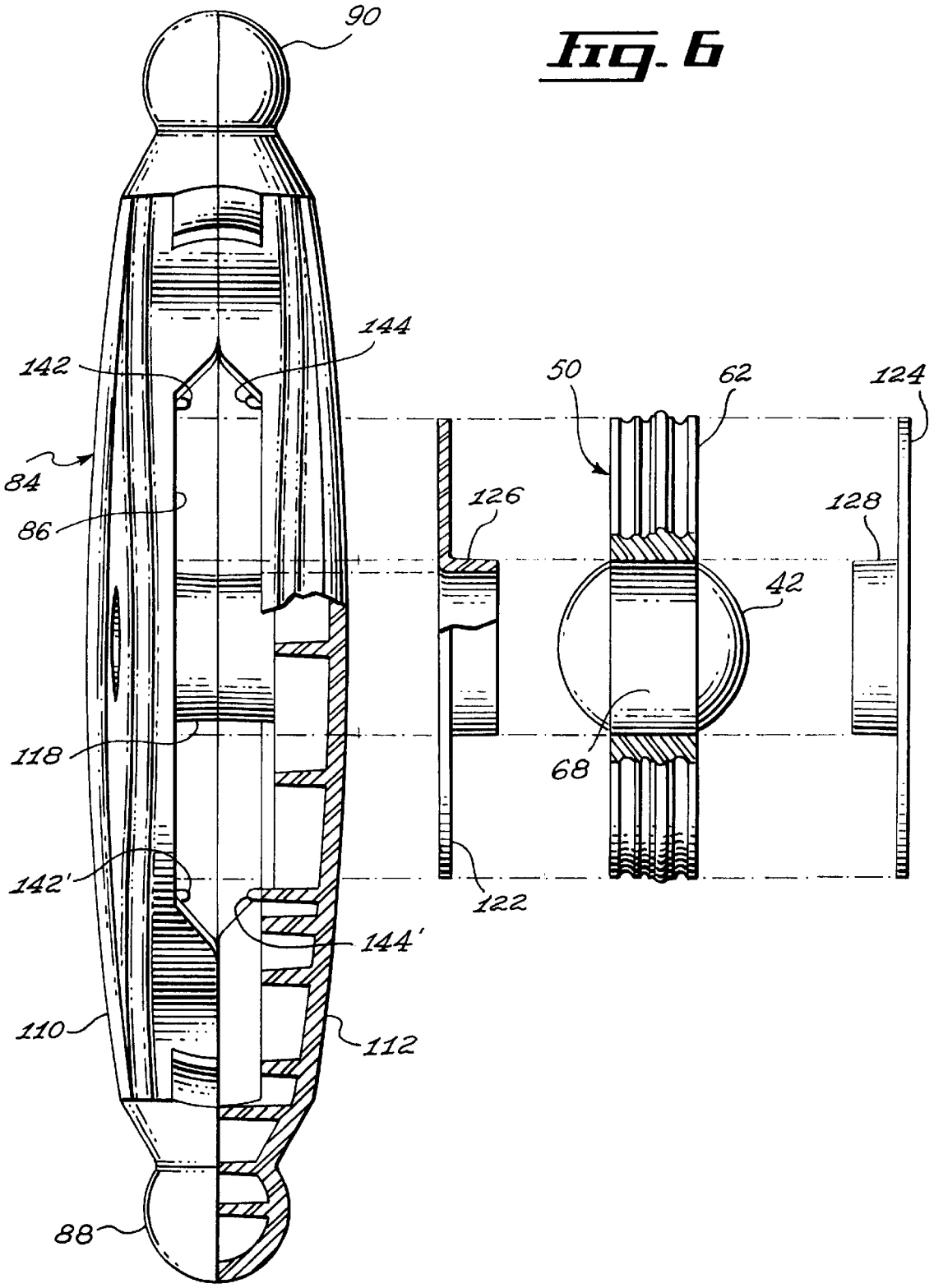
FIG. 6 is an enlarged, partly broken, exploded side elevation, partly in cross-section, of the casing of the mounting member of FIG. 2, suggesting the alignment in the casing of an oar sleeve member with its pair of slider rings.
Figure 7:
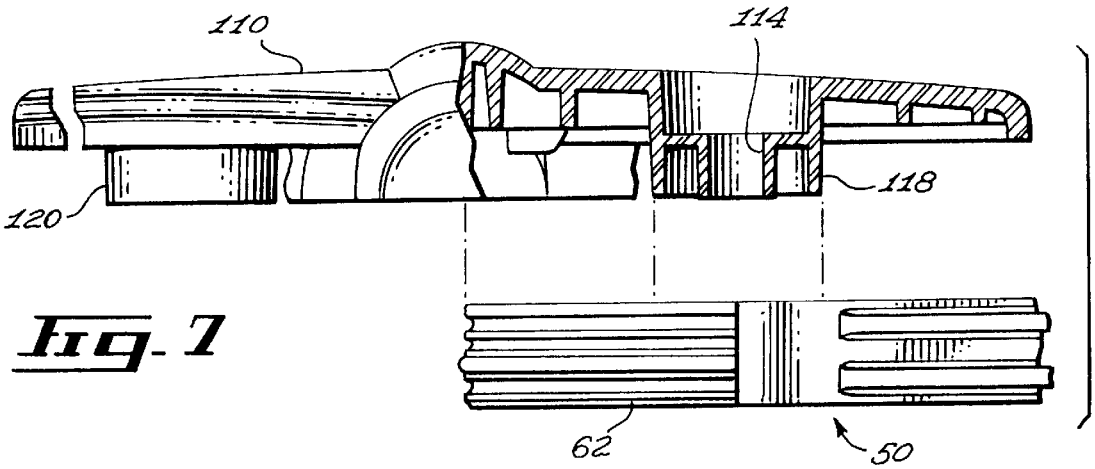
FIG. 7 is an enlarged, partly broken front elevation of one half of the casing of the mounting member of FIG. 2, partly in cross-section, suggesting the alignment of an oar sleeve member therein.

As shown in FIGS. 2, 3, 6 and 7, casing 84 is formed by two identical halves 110, 112 which are kept in abutment against each other by the ball joint members 88, 90 which engage the closed housings 108 of the socket members 92, 94. Furthermore, bolts (not shown) engage through-bores 114, 116 which are aligned to coaxially extend through both casing halves 110, 112. Bores 114, 116 are provided coaxially inside pivot posts 118, 120 which run transversely through the inner chamber located inside casing 84, between the spaced ribbed inner surfaces thereof. Thus, both sleeve members 50, 52 engage their respective openings 86, 87 with their head portions 62, with pivot posts 118, 120 engaging the central bore 68, 68' of the sleeve members 50, 52, respectively. Sleeve members 50, 52 can thus pivot about central posts 118, 120 in a same plane. Sleeves 42, 44 extend outwardly of casing 84 through openings 86, 87, thus allowing oar handle member 38*a* and oar paddle member 38*b* to pivot about casing 84 in a same plane. FIG. 6 further shows that a pair of upper and lower slider rings 122, 124 having a radial shoulder 126, 128 are provided over and under each cylindrical head portion 62 of sleeve members 50, 52, inside casing 84. Radial shoulders 126, 128 are inserted inside bore 68 and the main body of flat rings 122, 124 flatly engage the ribbed inner surface of casing 84 and the lower and upper surfaces 66, 64 of sleeve member head portion 62, to provide a smooth sliding engagement of sleeve head portion 62 when it pivots inside casing 84 about post 118. It is understood that sleeve member 52 is also equipped with a pair of slider rings (not shown).

Figure 8:
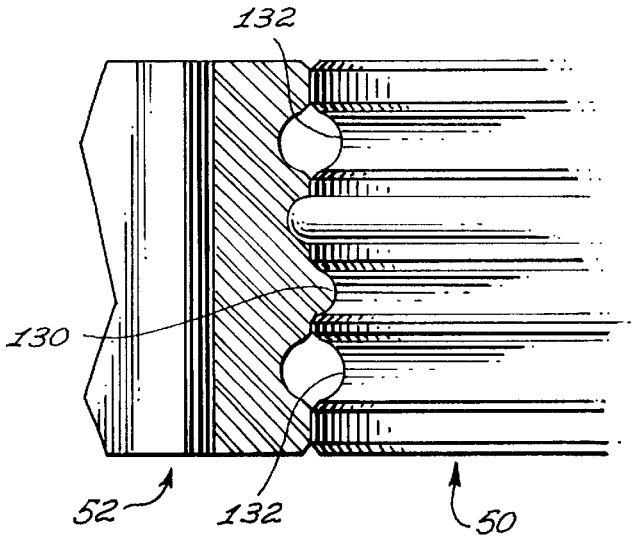
FIG. 8 is a partial enlarged elevation, partly in cross-section, showing the intermeshing engagement of the pivotal end portions of the head portions of two adjacent oar sleeve members.
Figure 9:
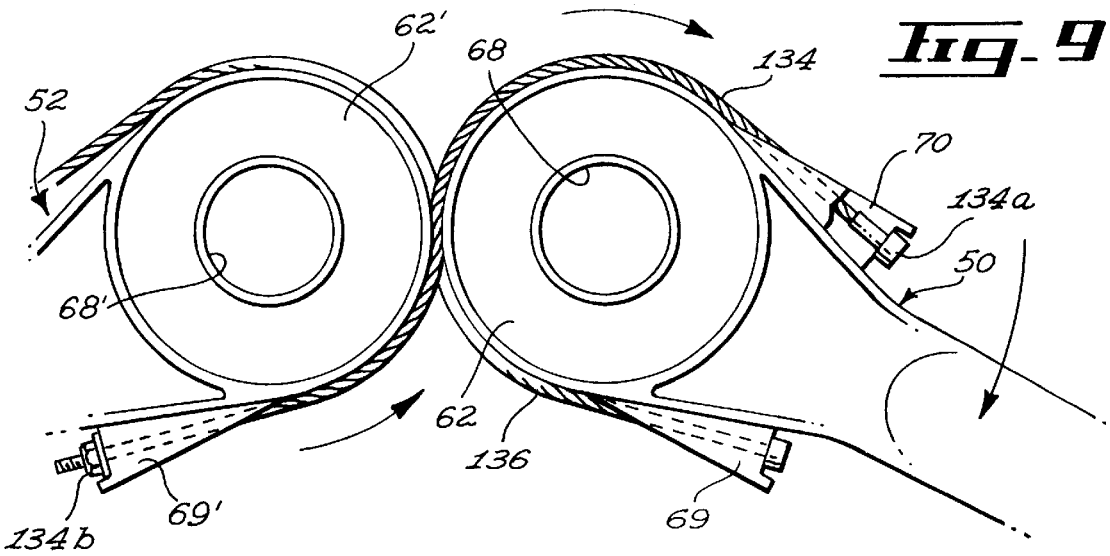
FIG. 9 is a top plan view of the cylindrical pivotal head portions of the oar sleeve members, showing the reversing wires interconnecting the two oar sleeve members for allowing pivotal displacement of the two oar sleeves only in opposite directions.

As shown in FIGS. 8 and 10, the radially outer portions of the head portions 62, 62' of the two adjacent sleeve members 50, 52 which are in facing register with each other, have a first tangentially extending radial groove 130 and a pair of second tangentially extending radial grooves 132, 132 therein, with first grooves 130 allowing a secure radial abutment of the two head portions 62, 62' of sleeve members 50, 52 against each other. Second grooves 132, as shown in FIGS. 8 and 9, allow the tangential engagement therein of wires 134, 136 which act as a reversing device and which interconnect the two sleeve members 50, 52. Each wire, for example wire 134, is fixed at its first diametrally larger end 134*a* on the shoulders of bracket 70 of the first sleeve member 50, and at its second diametrally larger end 134*b* to the bracket 69' of the other sleeve member 52, thus crossing between the two sleeve members 50, 52 through either one of the grooves 132 so that its two ends 134*a*, 134*b* be located on the opposite sides of the sleeve member head portions 62, 62'. The other wire 136 is installed in a similar fashion, although on the opposite free brackets 69, 70'. This crossing of wires 134, 136 allows, in a known fashion, the pivotal movement of sleeve members 50, 52 to be accomplished only in opposite directions in their common pivotal plane. As shown in FIG. 9, second wire end 134*b* can be threaded and engaged by a nut allowing effective length adjustment of wire 134.

FIG. 11 shows a pair ofjaws 138, 140 integrally depending inside casing 84, eachjaw 138, 140 being formed of a pair of bosses 142, 144 and 146, 148 on the ribbed inner surface of the casing halves 110, 112. Another pair of jaws is also located on the opposite side of casing 84, relative to the sleeve member head portions 62, 62'. As seen in FIGS. 3, 6 and 11–13, bosses 142, 144, 146, 148 and 142', 144', together with another pair of bosses (not shown) similar to bosses 146, 148, are located inside casing 84 on either side of the flat ribbed area where pivotal displacement of the head portions 62 and 62' of sleeve members 50, 52 occurs. Thus, the operative pivotal displacement of sleeve members 50, 52 is not hampered by the presence of the bosses. The bosses have a bevelled outer edge, which allows the brackets 69, 69' or 70, 70' of the two adjacent sleeve members 50, 52 to frictionally, resiliently, slidingly engage corresponding jaws 138, 140 to releasably fix the two sleeve members 50, 52 in an adjacent and parallel fashion (FIG. 13). The two plates forming a bracket, for example plates 72, 74, can indeed be resiliently slightly bent towards each other to allow their releasable frictional engagement into jaw 138. Thus, the corresponding oar handle member 38*a* and oar paddle member 38*b* can be temporarily releasably fixed in an uncumbersome fashion, by aligning them along the watercraft side edge portions.

Referring again to FIG. 1, it can be seen that attachment rods 104, 105 extend transversely through and into the watercraft hull main body 24, upwardly into the outrigger wings 26, 28, to protrude out through the outrigger wing outer lateral edge portions 26*a*, 28*a*. This allows a secure attachment of mounting members 34, 36 to the watercraft hull 22.

The present invention comprises several advantages over the prior art devices.

Firstly, the ball and socket joint is particularly advantageous in that it is not likely to allow the oars to accidentally be released from their mounting members, while still allowing full swivelling motion of the casing which encloses the oar reversing device and full pivotal displacement of oars 38, 40 about their casings. The fact that the casing 84 is located spacedly from its corresponding outrigger wing outer edge portions 26*a* contributes to allow a versatile swivelling motion, in which the oars are not likely to self-hamper this motion by being closely positioned to the outrigger wings.

Secondly, the transversely-extending rods allow a secure attachment of the oar mounting member onto the watercraft hull. Indeed, the embedded transversely-extending rods 104, 105 provide a secure attachment of the oar mounting members to the watercraft hull, effectively preventing the oar mounting members from being accidentally released during use, especially when important leverage forces are transferred through the mounting member during rowing motion by the rower.

Thirdly, each oar may be releasably aligned in an uncumbersome position when the watercraft is ashore or otherwise unused, i.e. with its oar handle member and its oar paddle member being positioned in parallel, adjacent fashion, next to the hull lateral side edge portion. This is accomplished due to the oar sleeve members frictionally releasably engaging the jaws located inside the mounting member casing.

Any modifications to the present invention, which do not deviate from the scope thereof, are considered to be included therein.

What is claimed is:

1. In combination, a watercraft and a frontface oar system mounted to said watercraft, said watercraft having an elongated hull defining a longitudinal axis linking a bow and a stem, and two side edge portions integrally flanking said hull, said frontface oar system comprising a pair of oars each having an oar paddle member defining a first end portion and a second opposite free paddle end portion, and an oar handle member defining a first end portion and a second opposite free handle end portion, said oar system further comprising a pair of oar mounting members each comprising:

a pair of longitudinally spaced-apart socket members fixedly attached to a corresponding said watercraft side edge portion, each said socket member defining an opened spherical housing having an opening in facing register with the opening of the other socket member of said pair of socket members;

an open casing having a pair of integral ball joint members each engaged in a respective socket housing through a corresponding said opening, for forming a ball and socket joint allowing swivelling displacement of said casing about an axis parallel to said watercraft longitudinal axis, with the first end portions of both said oar paddle member and said oar handle member being pivotally attached to said casing adjacent to each other for operative pivotal displacement of said oar members in a common pivotal plane;

a reversing device, operatively interconnecting the respective first ends of said oar paddle member and of said oar handle member for allowing pivotal displacement of said oar paddle member and said oar handle member only in opposite directions in said common pivotal plane;

wherein upon a said oar handle member being forcibly pivoted in a first direction, the corresponding said oar paddle member will be pivoted in an opposite direction in said common pivotal plane, and wherein said common pivotal plane can be angularly adjusted by forcibly swivelling said casings about said ball and socket joints, with said oar handle members acting as levers for swivelling said casings; and wherein said oar systems further comprises a pair of attachment rods each integrally linking a socket member of an oar mounting member with a corresponding socket member of the other oar mounting member from said pair of oar mounting members, with each said rod extending through and into said watercraft hull and transversely of said elongated hull.

2. The combination as defined in claim 1, wherein said attachment rods extend parallel to each other, with the frontmost socket member of each said pair of longitudinally spaced-apart socket members being linked to the frontmost socket member of the other pair of longitudinally spaced-apart socket members.

3. The combination as defined in claim 1, wherein said watercraft hull further defines a main elongated body and integral outrigger wings extending outwardly and upwardly from said main body so as to define lateral outer edge portions that form part of said hull side edge portions, with said oar mounting members being mounted to said lateral outer edge portions of said outrigger wings.

4. The combination as defined in claim 3, wherein said outrigger wings are arcuate and upwardly concave.

5. The combination as defined in claim 3, wherein said first end portions of said paddle and handle oar members are cylindrical and slidably pivot between spaced-apart flat walls defined in said casing, said paddle and handle oar members first end portions each having integral anchoring brackets radially projecting therefrom, and wherein said reversing device includes first and second flexible wires each anchored to a said bracket of said paddle oar member first end portion and to a said bracket of said handle oar member first end portion for allowing a pivotal displacement of said handle and paddle oar members only in opposite directions in said common pivotal plane.

6. The combination as defined in claim 5, wherein each said casing further comprises an integral jaw in which a bracket of at least either one of said handle oar member first end portion and said paddle oar member first end portion is releasably frictionally and resiliently engageable to allow said oar members to be releasably fixedly positioned and aligned along and adjacent respective said watercraft side edge portions in an uncumbersome inoperative position, while said jaw is positioned in said casing to allow unobstructed rowing pivotal displacement of said oars in positions spaced from inoperative position.

7. The combination as defined in claim 1, wherein each said casing further comprises an integral jaw in which at least either one of said handle oar member first end portion and said paddle oar member first end portion is releasably frictionally and resiliently engageable to allow said oar members to be releasably fixedly positioned and aligned along and adjacent said watercraft side edge portions in an uncumbersome inoperative position, with said jaw being positioned in said casing to allow unobstructed rowing pivotal displacement of said oars in positions spaced from said inoperative position.

* * * * *